US005918089A

United States Patent [19]

Malinich et al.

[11] Patent Number: 5,918,089

[45] Date of Patent: Jun. 29, 1999

[54] MODULAR CONTROL ASSEMBLY FOR XEROGRAPHIC PRINTER

[75] Inventors: Richard M. Malinich, Rochester; Jonathan T. Abbe, Webster, both of N.Y.

[73] Assignee: Xerox Corporation, Stamford, Conn.

[21] Appl. No.: 08/659,971

[22] Filed: Jun. 3, 1996

[51] Int. Cl.[6] ..... G03G 15/00

[52] U.S. Cl. ..... 399/90; 399/110; 361/809; 74/59

[58] Field of Search ..... 399/88, 90, 107, 399/110; 174/52.1, 59; 361/724, 725, 730, 731, 807, 809

[56] References Cited

U.S. PATENT DOCUMENTS

| | | | |
|---|---|---|---|
| 3,692,401 | 9/1972 | Kawai . | |
| 3,698,804 | 10/1972 | Cranskens et al. . | |
| 3,738,743 | 6/1973 | Hoffman et al. . | |
| 4,240,085 | 12/1980 | Tacklind et al. . | |
| 4,299,474 | 11/1981 | Ernst et al. . | |
| 4,558,391 | 12/1985 | Ward et al. | 361/155 |
| 5,001,516 | 3/1991 | Maruyama et al. . | |
| 5,001,602 | 3/1991 | Suffi et al. . | |
| 5,005,048 | 4/1991 | Leonhart | 355/93 |
| 5,028,154 | 7/1991 | Cull | 400/611 |
| 5,038,169 | 8/1991 | Marincic et al. | 355/200 |
| 5,235,494 | 8/1993 | Chang et al. . | |
| 5,238,317 | 8/1993 | Bohmer et al. | 400/693 |
| 5,298,941 | 3/1994 | Tenpaku . | |
| 5,414,492 | 5/1995 | Kubota . | |
| 5,452,072 | 9/1995 | Ichinokawa et al. | 355/271 |
| 5,561,496 | 10/1996 | Sugiura et al. . | |
| 5,561,499 | 10/1996 | Setoriyama . | |

FOREIGN PATENT DOCUMENTS

| | | |
|---|---|---|
| 61-129656 | 6/1986 | Japan . |
| 4-209484 | 7/1992 | Japan . |

*Primary Examiner*—Robert Beatty
*Attorney, Agent, or Firm*—John S. Wagley

[57] ABSTRACT

A modular control assembly for controlling a plurality of electromechanical components in a printing machine for producing prints on a substrate is provided. The assembly includes a body, a plurality of electrical components mounted onto the body. The assembly further includes a plurality of electrical conduits. Each of the conduits is electrically connected to at least one of the electrical components. The assembly further includes a plurality of electrical connectors. Each of the connectors is electrically connected to at least one of the electrical conduits. The electromechanical components are quickly electrically connectable and disconnectable to the assembly at the connectors.

19 Claims, 7 Drawing Sheets

MODULAR CONTROL ASSEMBLY FOR XEROGRAPHIC PRINTER

The present invention relates to electrical cabinets for use in electrophotographic printing machines. More particularly, the invention relates to modular control assemblies.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

High speed copying machines are becoming increasingly popular. These machines have a capacity or output capacity of say, for example, over 60 copies per minute. These machines are able to use single cut sheets of paper of various size such as A4, 8½×11, or 8½×14 inch copy sheets. These machines may be of the light lens, xerographic machine or may be a printer with digital input. Single, cut sheet printing machines are now available at speeds around 200 cpm.

Modern large copiers and printers require a large number of electromechanical components, for example, motors, lamps, charging devices, fusing rolls and other electromechanical components which require control circuitry to operate. To provide for an efficient and smooth uninterrupted flow of the substrate, for example, copy sheets to progress through the copy machine or printer, the mechanical components must be arranged to provide for this simple flow of the paper. In the design process, the mechanical components are thus laid out as required to accomplish the electrostatographic process. After the component design engineers have placed the mechanical components as required within the machine, the control system is later packaged.

Currently, on most existing printers and copiers, the electro control system is packaged in various internal areas throughout the machine. Consequently, there are many mechanical subassemblies located all throughout the product. The control boards may be packaged in a card cage or strung out on panels on the back or sides of the machine. The power supply may be in another part of the machine, as will the power distribution circuitry for the AC system. All of these components are interconnected by the use of many long and complex harnesses.

There are many deficiencies or shortfalls with conventional packaging techniques. Included among these deficiencies are that because the electrical system is placed in the available resulting space or location, the designs result in cramped spaces, making them modules and the entire machine difficult to assemble and service. The difficulty in service is particularly plaguing as the copiers and printers, particularly those for high volume machines, have a very long service life and may require a considerable number of service calls through this very extended service life.

In the movement to higher speed copiers and printers with greater product output, in particular due to the large amount of heat required to fuse the toner to the paper at the fusing station, these larger machine tend to work and be at higher temperatures throughout the machine. The higher temperatures of modern high speed copying machines are exasperated due to the reduced natural air flow within the machine as a result of the cramped spaces. This may require the additional of fans and other expensive subsystems, for example, air conditioning systems to solve the problem.

Because of the suboptimal location of the electrical components throughout the available spaces within the machine, long and complex wiring harness assemblies with multiple connector interfaces are required to interconnect all the various parts. These long harnesses strung throughout the product are more susceptible to EME (Electro Magnetic Emissions) and more likely to emit a higher level of EMI (ElectroMechanical Interference). The harnesses are also more susceptible to damage by getting in the way of other moving parts.

Furthermore, because of the use of the various spaces within the machine, more effort is required to integrate the electrical designs with the mechanical designs to prevent interference and other compatibility problems. This is particularly true with respect to the interference of those components powered by direct current with those components powered by alternating current. This situation is also exasperated by changes in design of the mechanical components through the development of the machine which will necessitate the redesign of the electrical system because of the resultant changes in the allowable locations for the electrical components. This interaction between electrical component design and mechanical component design further lengthens the "time to market" required to go from product concept to a marketable product.

Furthermore, the addition of large electrical components, for example, transformers, may require that these components be located outside the frame of the machine. Components located outside the frame of the machine may result in the width of the machine being larger than is desired. Furthermore, the addition of the electrical components within the machine frame may require the interior of the frame to be widened as well. These large copy machines for producing high volumes of copies are large, yet are required to be located in an office environment. When that office environment is an old building with narrow doorways, a particular problem is presented in that the copy machine or printer may not fit within the width of the doorway. This is particularly a problem in Europe where more older buildings are utilized.

The modular control assembly of the present invention is intended to alleviate at least some of the problems heretofore mentioned.

The following disclosures relate to the area of inserting one or more insert sheets among a plurality of previously marked sheets:

U.S. Pat. No. 5,452,072

Patentees: Ichinokawa et al.

Issued: Sep. 19, 1995

U.S. Pat. No. 5,038,169

Patentees: Marincic et al.

Issued: Aug. 6, 1991

U.S. Pat. No. 5,028,154

Patentees: Cull

Issued: Jul. 2, 1991

U.S. Pat. No. 5,005,048

Patentees: Leonhart

Issued: Apr. 2, 1991

U.S. Pat. No. 3,738,743

Patentees: Hoffman et al.

Issued: Jun. 12, 1973

U.S. Pat. No. 3,698,804

Patentees: Cranskens et al.

Issued: Oct. 17, 1972

U.S. Pat. No. 3,692,401

Patentees: Kawai

Issued: Sep. 19, 1972

U.S. Pat. No. 5,452,072 discloses an electrophotographic copy machine including a photoconductive drum and a housing for supporting the drum. The machine further includes a control assembly for controlling the functions of the machine. The control assembly has an upper housing button movably attached to a swing frame When the swing frame is turned upwardly the upper opening of the housing is opened for easy removal of jams and for servicing of components.

U.S. Pat. No. 5,038,169 discloses a printer for printing copy sheets. The printer has an upper surface with an access panel for sheet path access. The printer includes a control panel for controlling the functions of the printer. The control panel extends over the access panel. The control panel is laterally slidably mounted to the printer to be moveable to a position in clearance with the access panel.

U.S. Pat. No. 5,028,154 discloses a printing station for a printer. The printer further includes a control panel located near a front edge of the printer. The panel is interconnected to a ribbon cable by an electrically shielded connector terminate to the free end of the ribbon cable. The printer also includes an opening or port having a shielded connector mounted therein which is complementary with the shielded connector.

U.S. Pat. No. 5,005,048 discloses a graphic arts exposure device having a cabinet defining a work surface. A drawer is positioned below the work surface. The drawer has an extended position and a retracted position. A control panel is mounted on the drawer. The control panel is moveable with the drawer to permit easy use by an operator.

U.S. Pat. No. 3,738,743 discloses a flat bed electrostatic photocopier utilizing a U-shaped feed path for feeding successive copy sheets from a supply through various processing stations. All segments of the feed path are adjacent the perimeter of the copier and accessible through openings in the copier. Doors assist in the accessibility of the copier. The paper transport is pivotable to further assist in accessibility.

U.S. Pat. No. 3,698,804 discloses a copying apparatus contained within a housing. The apparatus includes a charging unit and a developing device containing media. The housing includes a number of openable covers for gaining access to the interior of the copier. By opening the covers in the housing and removing associated parts inwards of the cover it is possible to gain access to the different paths of the copying paper.

U.S. Pat. No. 3,692,401 copier with a corona discharge device. The copier includes a series of doors and other hinged parts for obtaining access to the machine. A safety switch is secured to the machine for quickly releasing the charge on the high voltage capacitor simultaneously when the door or hinged part is opened.

In accordance with one aspect of the present invention there is provided a modular control assembly for controlling a plurality of electromechanical components in a printing machine for producing prints on a substrate. The assembly includes a body, a plurality of electrical components mounted onto the body. The assembly further includes a plurality of electrical conduits. Each of the conduits is electrically connected to at least one of the electrical components. The assembly further includes a plurality of electrical connectors. Each of the connectors is electrically connected to at least one of the electrical conduits. The electromechanical components are quickly electrically connectable and disconnectable to the assembly at the connectors.

In accordance with another aspect of the present invention there is provided a printing machine for producing prints on a substrate comprising a modular control assembly for controlling a plurality of electromechanical components. The assembly includes a body, a plurality of electrical components mounted onto the body. The assembly further includes a plurality of electrical conduits. Each of the conduits is electrically connected to at least one of the electrical components. The assembly further includes a plurality of electrical connectors. Each of the connectors is electrically connected to at least one of the electrical conduits. The electromechanical components are quickly electrically connectable and disconnectable to the assembly at the connectors.

These and other aspects of the invention will become apparent from the following description, the description being used to illustrate a preferred embodiment of the invention when read in conjunction with the accompanying drawings.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 2:
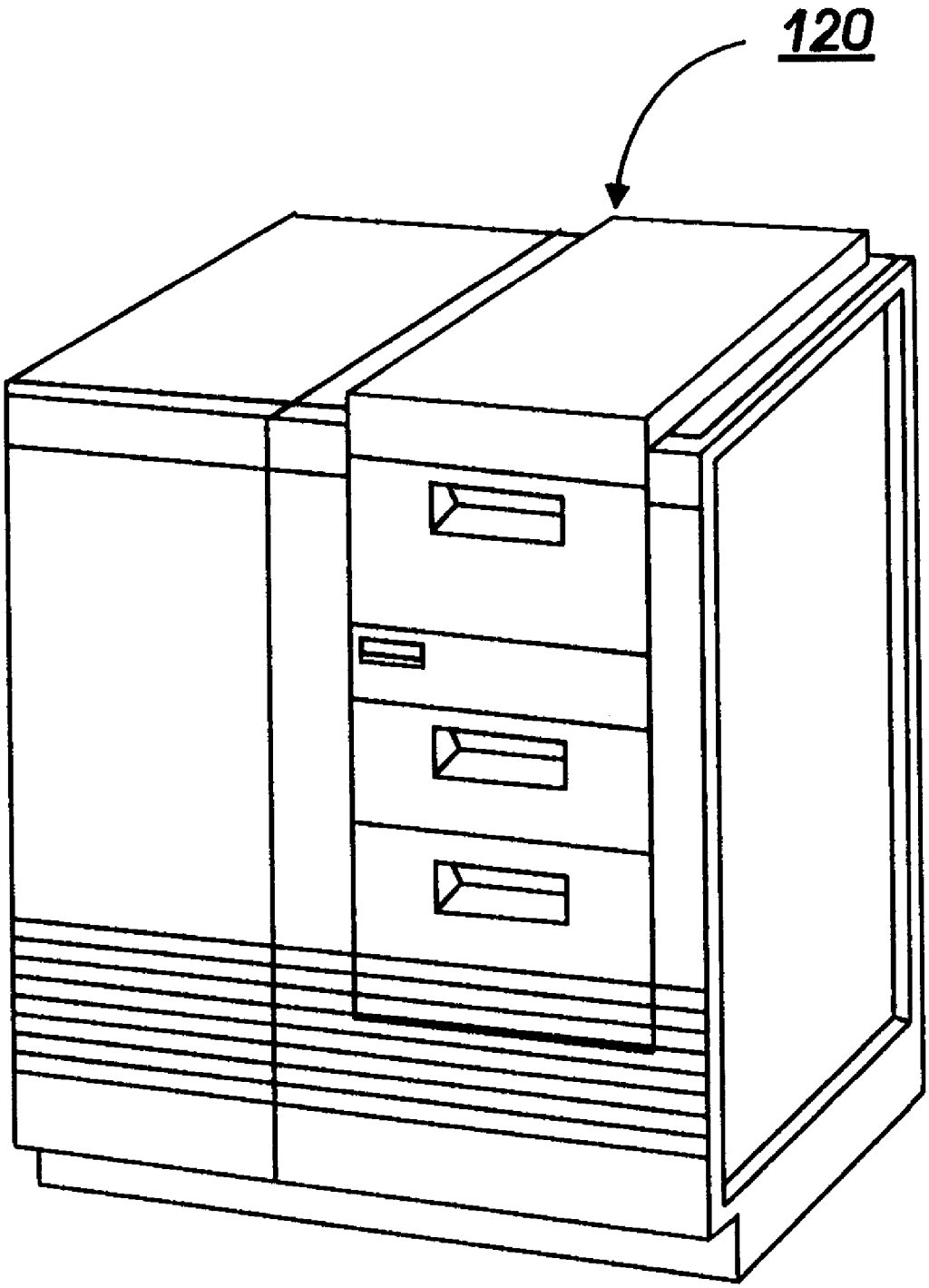
FIG. 2 is a perspective view of an interposer utilizing the modular control assembly of FIG. 1.
Figure 3:
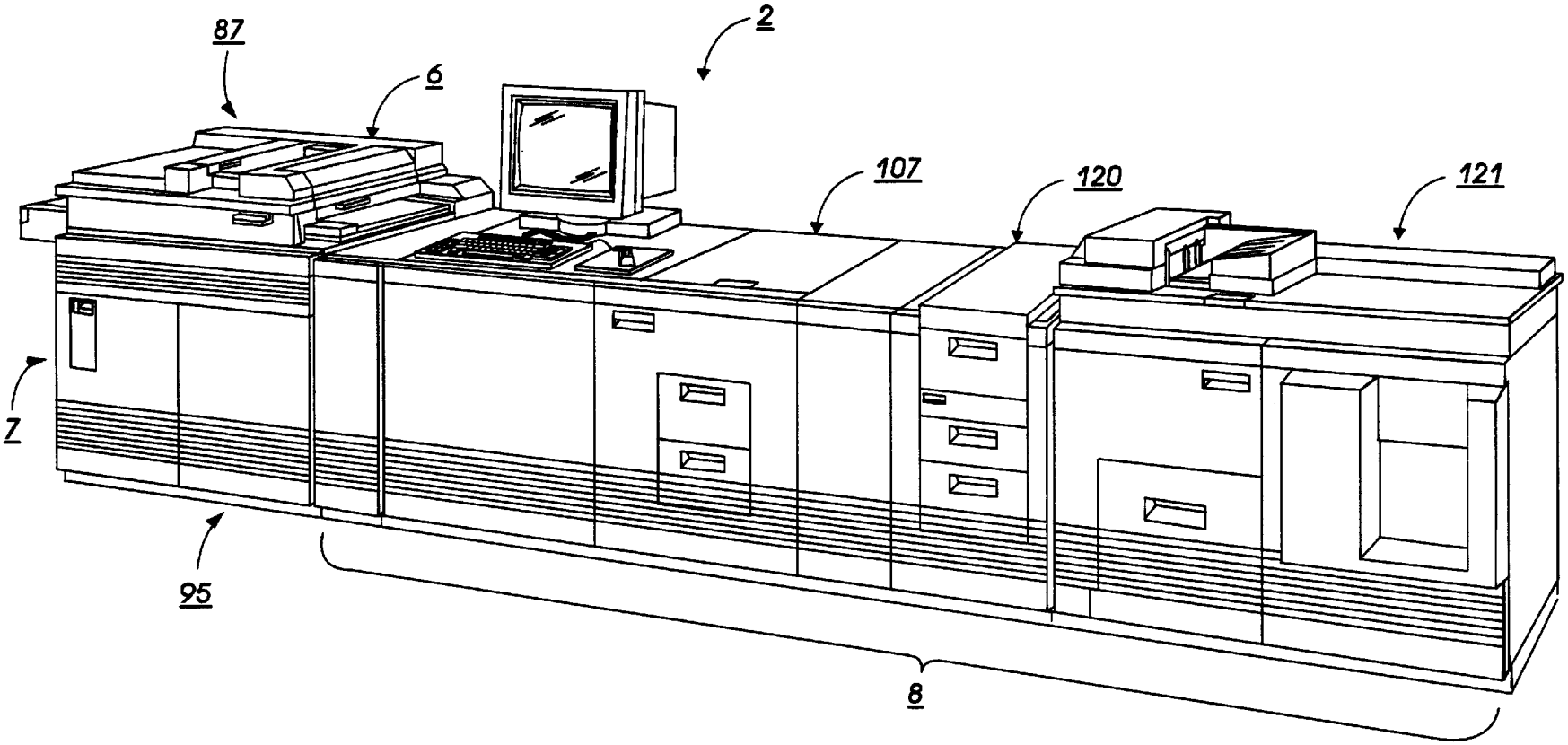
FIG. 3 is a perspective view of an electronic printing system including the interposer of FIG. 2.

Referring to FIGS. 2 and 3, there is shown an exemplary laser based printing system (or imaging device) 2 for processing print jobs in accordance with the teachings of the present invention. Printing system 2, for purposes of explanation, is divided into a scanner section 6, controller section 7, and printer section 8. While a specific printing system is shown and described, the present invention may be used with other types of printing systems such as ink jet, ionographic, etc., equivalents as may be included within the spirit and scope of the invention as defined by the appended claims. It should be particularly noted that the modular control assembly of the present invention may be practiced equally as well on a light lens type of xerographic copier.

For off-site image input, image input section has a network with a suitable communication channel, such as an ethernet connection, enabling image data, in the form of image signals or pixels, from one or more remote sources, to be input to system 2 for processing. Other remote sources of image data, such as streaming tape, floppy disk, video camera, etc. may be envisioned.

Figure 4:
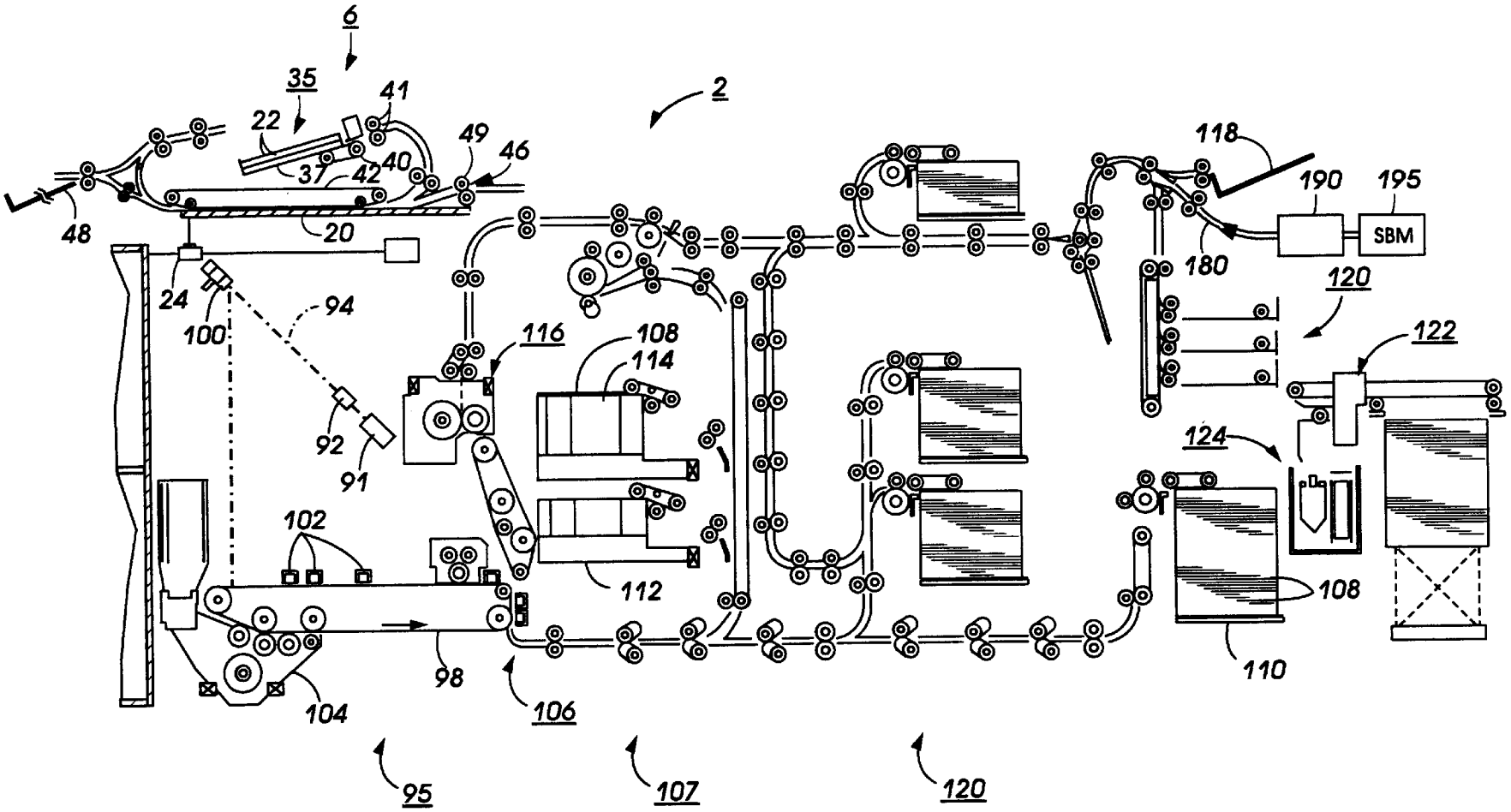
FIG. 4 is a schematic view of the elevational view illustrating the principal mechanical components and paper path of the printing system shown in FIG. 3.

Referring particularly to FIGS. 3–4, scanner section 6 incorporates a transparent platen 20 on which the document 22 to be scanned is located. One or more linear arrays 24 are supported for reciprocating scanning movement below platen 20. Array 24 provides image signals or pixels representative of the image scanned which, after suitable processing by processor (not shown), are output to controller section 7.

Processor converts the analog image signals output by array 24 to digital image signals and processes the image signals as required to enable system 2 to store and handle the image data in the form required to carry out the job programmed. Processor also provides enhancements and changes to the image signals such as filtering, thresholding, screening, cropping, reduction/enlarging, etc. Following any changes and adjustments in the job program, the document must be rescanned.

Documents 22 to be scanned may be located on platen 20 for scanning by automatic document handler (ADF) 35 operable in either a Recirculating Document Handling (RDH) mode or a Semi-Automatic Document Handling (SADH) mode. A manual mode including a Book mode and a Computer Forms Feeder (CFF) mode are also provided, the latter to accommodate documents in the form of computer fanfold. For RDH mode operation, document handler 35 has a document tray 37 in which documents 22 are arranged in stacks or batches. The documents 22 in tray 37 are advanced by vacuum feed belt 40 and feed rolls 41 onto platen 20 where the document is scanned by array 24. Following scanning, the document is removed from platen 20 and discharged into catch tray 48.

For operation in the CFF mode, computer forms material is fed through slot 46 and advanced by feed rolls 49 to document feed belt 42 which, in turn, advances a page of the fanfold material into position on platen 20.

Referring to FIGS. 3 and 4, printer section 8 comprises a laser type printer and, for purposes of explanation, is separated into a Raster Output Scanner (ROS) section 87, Print Module Section 95, Paper Supply Section 107, a post-xerographic paper processor, for example an interposer 120 for interposing sheets of preprinted stock into printed sheets from the xerographic engine and for supplying addition copy sheets for the xerographic engine and a High Speed Finisher 121. ROS 87 has a laser 91, the beam of which is split into two imaging beams 94. Each beam 94 is modulated in accordance with the content of an image signal input by acousto-optic modulator 92 to provide dual imaging beams 94. Beams 94 are scanned across a moving photoreceptor 98 of Print Module 95 by the mirrored facets of a rotating polygon 100 to expose two image lines on photoreceptor 98 with each scan and create the latent electrostatic images represented by the image signal input to modulator 92. Photoreceptor 98 is uniformly charged by corotrons 102 at a charging station preparatory to exposure by imaging beams 94. The latent electrostatic images are developed by developer 104 and transferred at transfer station 106 to a print media 108 delivered by Paper Supply section 107. Media 108, as will appear, may comprise any of a variety of sheet sizes, types, and colors. For transfer, the print media is brought forward in timed registration with the developed image on photoreceptor 98 from either a main paper tray 110 or from auxiliary paper trays 112 or 114. The developed image transferred to the print media 108 is permanently fixed or fused by fuser 116 and the resulting prints pass through interposer 120 and are discharged to either output tray 118, to high speed finisher 121, or through bypass 180 to some other downstream finishing device, which could be a low speed finishing device such as a signature booklet maker (SBM) 195 of the type manufactured by Bourg AB. High speed finisher 121 includes a stitcher 122 for stitching or stapling the prints together to form books and thermal binder 124 for adhesively binding the prints into books.

Referring still to FIG. 4, the SBM 195 is coupled with the printing system 2, by way of bypass 180, for receiving printed signatures. A sheet rotary 190 is positioned at an input of the SBM and the SBM includes three stations, namely a stitching station, a folding station and a trimming station, in which a plurality of signatures are processed. In operation, the signatures are transported through the bypass 180 to the sheet rotary 190 where the signatures are rotated, if necessary. The signatures are then introduced to the stitching station where the signatures are assembled as a stitched booklet. The stitched booklet is delivered to the folding station where it is preferably folded in half with a folding bar. At the trimming station, uneven edges of the folded signature set are trimmed with a cutting blade. Further details regarding the structure and function of the SBM 195 can be obtained by reference to U.S. Pat. No. 5,159,395 to Farrell et al.

Figure 1:
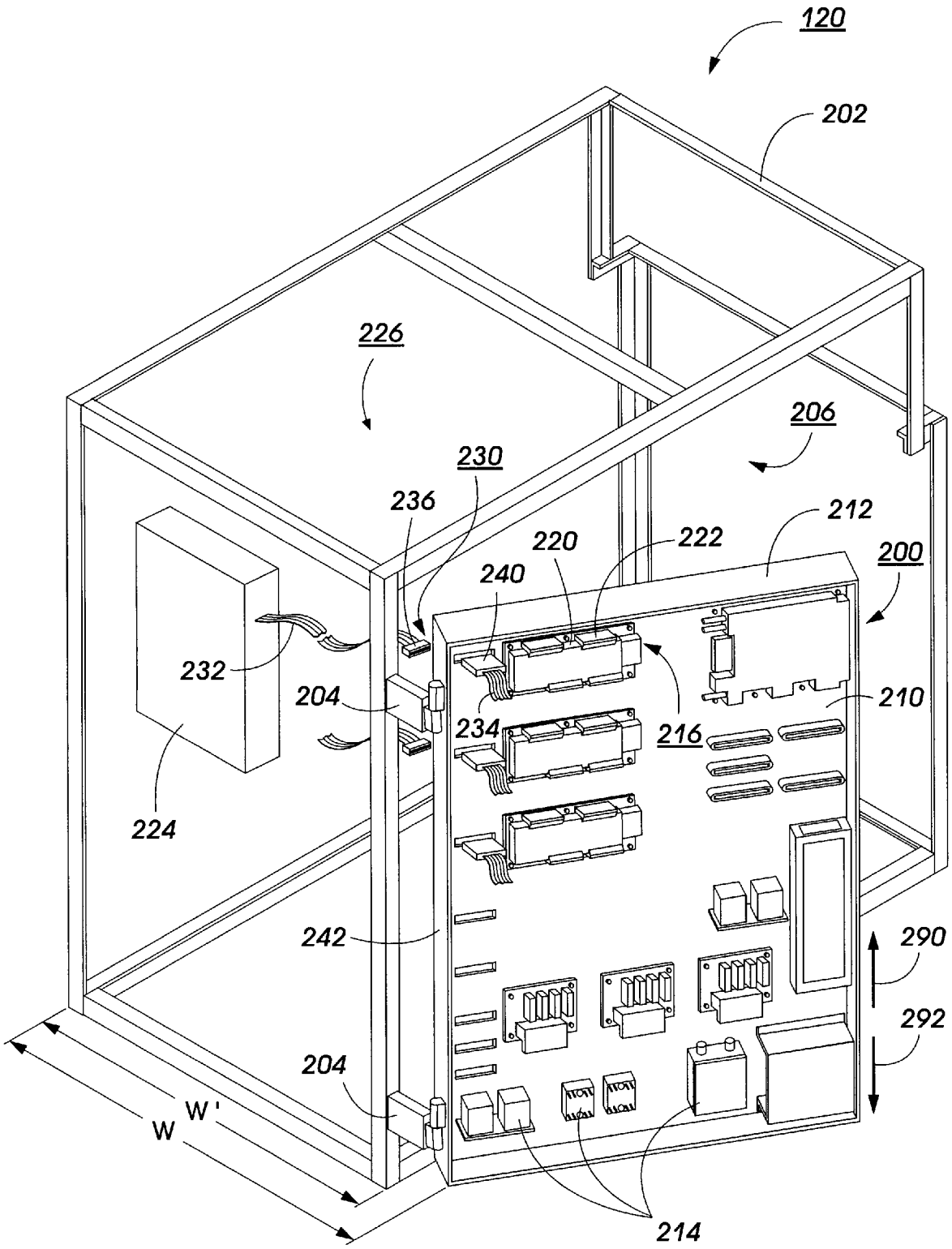
FIG. 1 is a perspective view of a modular control assembly according to the present invention.

According to the present invention and referring to FIG. 1, a modular control assembly in the form of assembly assembly 200 is shown. The modular control assembly 200 is mounted to the interposer 120. The modular control assembly 200 may be mounted to the interposer 120 in any suitable fashion, for example, the modular control assembly 200 may be mounted to frame 202 of the interposer 120.

It should be appreciated that while as shown in FIG. 1 modular control assembly 200 is mounted to interposer 120, the modular control assembly 200 may likewise be mounted to the copy machine or printer 8 (see FIGS. 2–4) or to any other copier, printer, or copier or printer subsystem.

The modular control assembly 200 may be mounted to the frame 202 in any suitable fashion, for example, the modular control assembly 200 may be mounted to the frame 202 by means of hinge 204. It should be appreciated, however, that the modular control assembly 200 may likewise be connected to frame 202 by means of fasteners (not shown) such as screws or bolts or be slide mounted in a sliding apparatus (not shown) connected to the frame 202. The use of the hinge 204 is particularly advantageous in that the modular control assembly 200 can be opened to permit access to interior 206 of the interposer 120 without the need to utilize any tools or to add any significant time to opening the assembly 200.

The frame 202 has a width W' which is less than the width W of the interposer 120 including the frame 202 and the modular control assembly 200. The width of the machine may be reduced from W to W' by removal of the modular control assembly 200 providing for greater accessibility through narrow halls and doorways.

The modular control assembly 200 includes a body 210. The body 210 may have any suitable shape but in order to obtain easy access to the interior 206 of the interposer 120, the body 210 preferably in the form of a plate. The plate 210 may have any suitable shape, for example, a rectangular plate and be made of any suitable material, for example, sheet steel or molded plastic. The use of sheet metal, or aluminum is preferred to provide an integral grounding circuit for the control assembly 200. The plate 210 may be a flat plate or, as shown in FIG. 1, include sides 212 which extend outwardly and normal to the body 210 and serve to add strength and rigidity to the plate 210.

Electrical components 214 are mounted onto the body 210 in any suitable fashion. For example, the electrical components 214 may be permanently affixed to the body 210 by welding, rivets or be removably fixed by screws or bolts. Preferably, however, the electrical components 214 are quickly removable from the body 210 by means of a mounting apparatus 216.

Mounting apparatus 216 may be of any suitable form capable of providing for a quick installation and disassembly of the electrical component 214 into the mounting apparatus 216. For example, the electrical component 214 may have supports 220 to which rails 222 on the mounting apparatus 216 may slidably mount into.

At least some of the electrical components 214 are electrically connected to devices 224. The devices 224 may be electrical, such as a fusing roll electrical element, or electrical/mechanical, for example, an electrical motor.

The devices 224 are electrically connected to the electrical component 214 in any suitable manner, for example, by an electrical conduit 226. The electrical conduit 226 is typically in the form of an electrical wire. Typically, the electrical wire 226 is shielded by an insulating material. The electrical wire is made of an electrically conductive material, typically, copper and in some instances, aluminum. It should be appreciated, however, that the electrical conduit 226 may be any suitable electrically conductive material, for example, fiber optics or other electrically conductive material.

To assist in the easy removal of the modular control assembly 200, the electrical conduit 226 typically includes a connector 230 which is positioned between a device electrical conduit 232 and a assembly electrical conduit 234. The connector 230 is any suitable electrical conductor and typically includes a mechanism which permits the quick connection and disconnection of the connector 230.

The connector 230 thus typically includes a first portion 236 as well as a second portion 240. The first portion 236 is electrically connected to device electrical conduit 232 while the second portion 240 is electrically connected to the assembly electrical conduit 234.

To simplify the removal of the modular control assembly 200 from the frame 202, the connectors 230 are typically located near a first edge 242 of the assembly 200 adjacent the hinges 204. While the invention may be practiced with separable distinct connectors 230, it should be appreciated that the connectors 230 may be mechanically connected to provide for one disconnection of all the device electrical conduits 232 from the assembly electrical conduits 234 simultaneously.

As stated earlier, the modular control assembly 200 may be removable from the frame 220 in any suitable fashion, for example, as shown in FIG. 1, the modular control assembly 200 rotates about frame 202 through the hinge 204. While a solitary hinge 204 may be used, preferably, the assembly 200 is mounted to the frame 202 by separate, spaced apart hinges 204.

Figure 5:
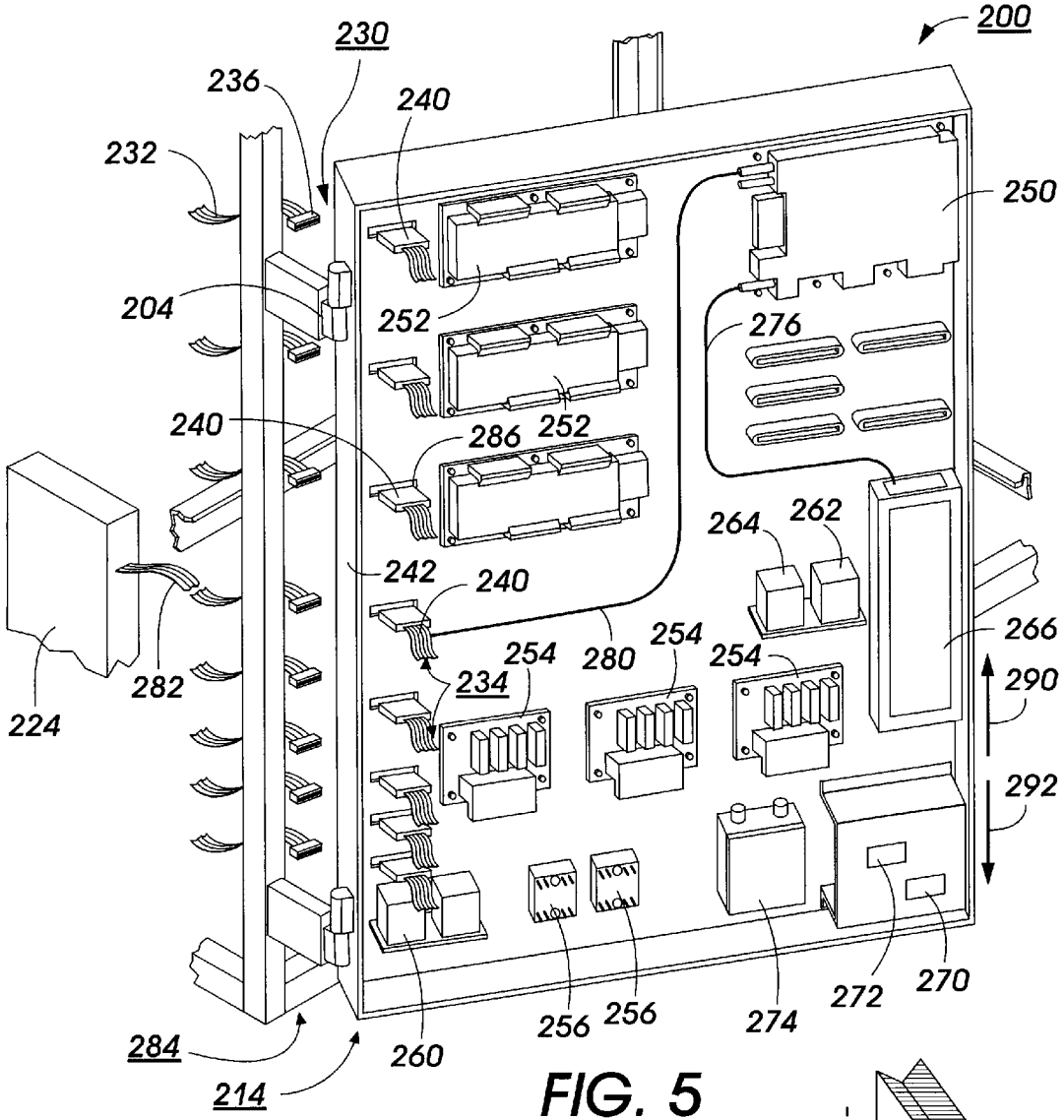
FIG. 5 is a perspective view of the frame of the interposer of FIG. 2 depicting the modular control assembly of FIG. 1.

The modular control assembly 200 is shown in greater detail in FIG. 5. The modular control assembly 200 contains typically a plurality of electrical components 214. The electrical components 214 may include a wide variety of different electrical components 214. For example, as shown in FIG. 5, the electrical components 214 may include a core PWBA (printed wiring board assembly) generally noted by the reference numeral 250. The core PWBA is electrically connected to at least one of the electrical components 214 or to one electrical or mechanical device 224.

Preferably, the assembly 200 is used to contain a wide variety of electrical components 214 in addition to the core PWBA 250. For example, the assembly 200 may support digital input/output (DIO), PWBAs 252. For example, as shown in FIG. 5 the assembly 200 may include three DIO PWBAs 252. The assembly 200 may also include alternating current (AC) remote PWBAs 254. As shown in FIG. 5 the assembly 200 may include three AC remote PWBAs 254. The assembly 200 may also include solid state relays 256. Further, the assembly 200 may include interlock relays 260.

As shown in FIG. 5, the assembly 200 may further include AC power on relay 262 and DC power on relay 264. The assembly 200 may also include power supply 266. The power supply 266 supplies both a five volt DC circuit for the control system as well as a 24 volt DC circuit for electrical components. The assembly 200 may also include AC line cord connection 270 as well as ground GFI (ground fault interruption) circuit 272. The assembly 200 may further include line filter 274.

The core PWBA 250 may be electrically connected to other electrical components. For example, the core PWBA 250 may be connected to power supply 266 by means of core PWBA 250 electrical component conduit 276. Further, the core PWBA 250 may be electrically connected to connector 230 by core PWBA assembly electrical conduit 280. The core PWBA 250 is further electrically connected to at least one of the electrical or electromechanical devices 224 by core PWBA electromechanical device conduit 282.

As shown in FIG. 5, preferably the connectors 230 are located adjacent first face 242 of the assembly 200. The connectors 230 form a connector interface area 284 adjacent the first face 242. Second portion 240 of the connector 230 is attached to assembly 200 in any suitable fashion. For example, as shown in FIG. 5, the second portion 240 of connector 230 is located in slot 286 of assembly 200. The slots 286 are located near first face 242 of the assembly 200.

As shown in FIG. 5, a plurality of connectors 230 are located on the assembly 200 with each of the connectors 230 located in one of the slots 286. It should be appreciated, however, that the invention may be practiced with a solitary connector 243, as shown in phantom in FIG. 6, extending along the length of the first face 242 with all interconnections between the assembly 200 and the interposer 120 being made with the disconnector.

While the electrical components 214 may be positioned on assembly 200 in any suitable fashion, preferably, the electrical components are segregated with AC components and DC components taking up separate portions of the assembly 200. Separating AC components from DC components within the assembly 200 provides EMI (Electro Magnetic Immunity) of the sophisticated electrical components therefore removing noise and EME (Electro Magnetic Emissions) from disrupting the electrical components 214. The assembly 200 is separated into a DC portion 290 and an AC portion 292.

Figure 5A:
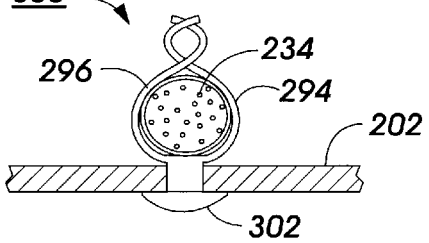
FIG. 5A is a plan view partially in section of a twist clamp for use with the modular control assembly of FIG. 1.

While assembly electrical conduits 234 may be secured to the assembly 200 in any suitable fashion, referring now to FIG. 5A a twist clamp 294 for use with assembly 200 is shown. The twist clamp 294 includes a first portion 296 and a second portion 300 of the twist clamp 294 to hold conduits 234 in position. The twist clamp 294 is secured to the assembly 200 in any suitable fashion such as by compressible detent 302.

Figure 5B:
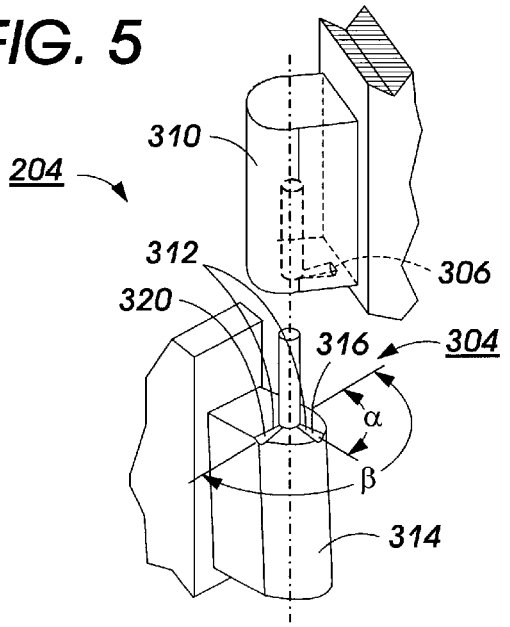
FIG. 5B is a perspective view of a positioning detent for the hinge of the modular control assembly of FIG. 1.

Referring now to FIG. 5B, hinge 204 is shown in greater detail. The hinge 204 preferably includes a feature 300 utilized to bias positioning of the assembly 200 into a particular position. The feature 300 may be accomplished in any suitable form, for example as shown in FIG. 5B, by a protrusion 306, for example in the form of a wedge, tooth, or camming surface protruding from upper portion 310 of the hinge 204. The protrusion 306 mates with an indentation 312, groove or camming surface in lower portion 314 of the hinge 204. The indentation 312 is positioned relative to the protrusion 306 such that the assembly 200 is biased in a particular position relative to the interposer 120. For example, the indentation 312 may be positioned such that assembly 200 has a first biased position 316 with the assembly 200 and the interposer 120 forming an angle (ALPHA) of approximately 80 degrees therebetween as well as a second position 320 with the assembly 200 and the interposer 120 forming an angle (BETA) approximately 170 degrees therebetween. These biased positions 316 and 320 provide for an access for a service person during troubleshooting the machine.

Figure 6:
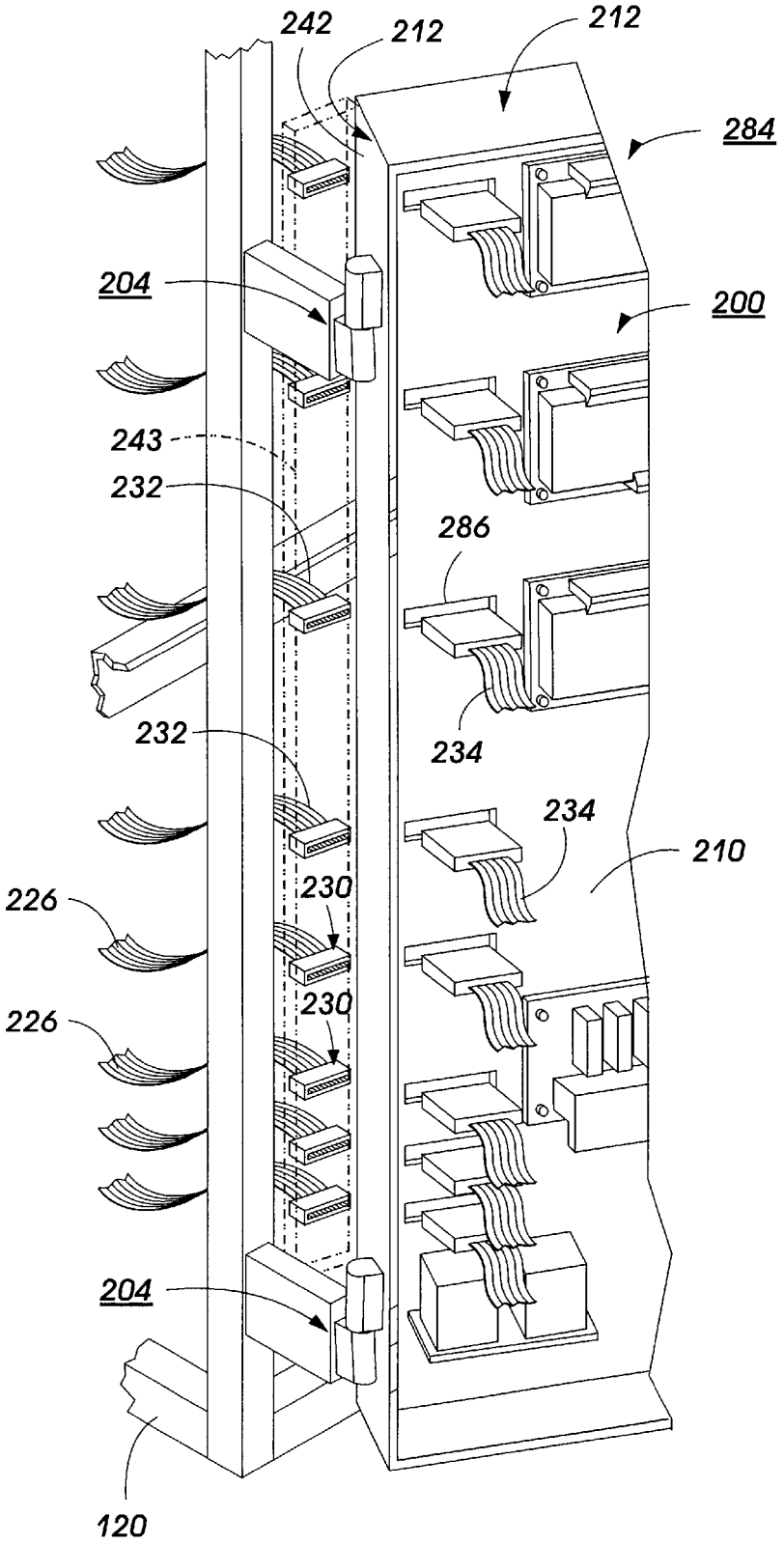
FIG. 6 is a partial perspective view of the modular control assembly of FIG. 1 showing modular connections.

Referring now to FIG. 6, the connector interface area 284 is shown in greater detail. As shown in FIG. 6, the machine electrical conduits 226 are interconnected to the assembly 200 at the electrical connectors 230. By positioning the connectors 230 near the hinges 204, and by providing connectors 230 which are easily separable into first portion 236 and second portion 240 of the connector 230, the assembly 200 may be easily removed from the interposer 120.

Figure 6A:
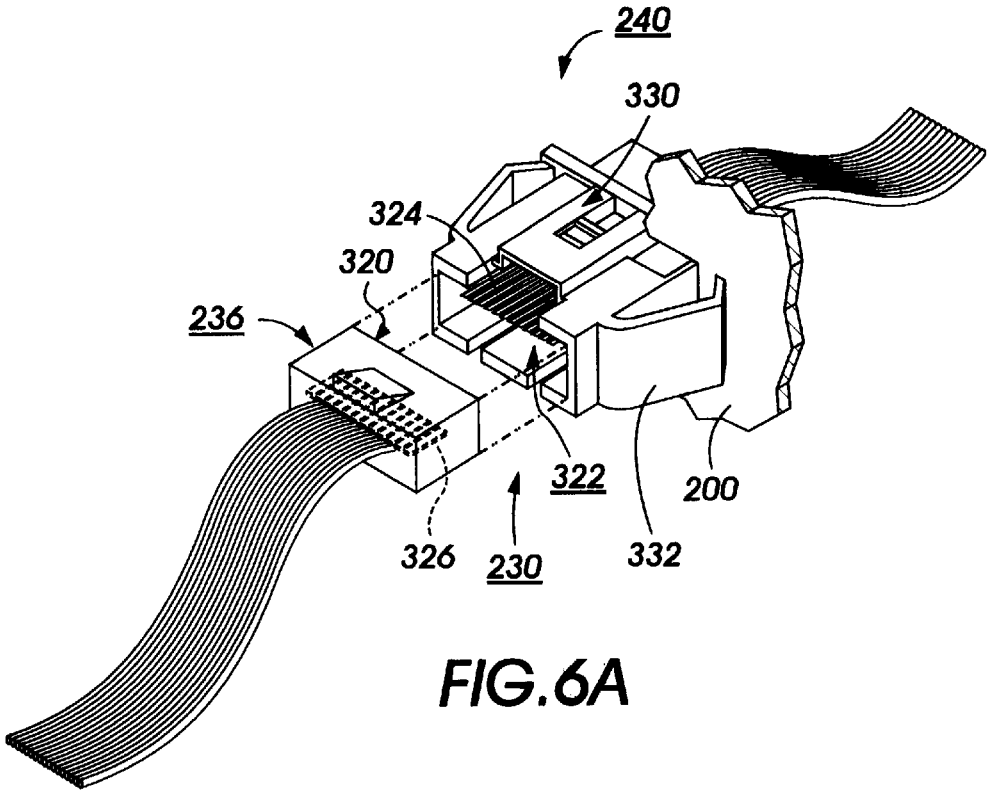
FIG. 6A is a partial plan view of a modular connector for the modular connections of FIG. 6.

Referring now to FIG. 6A, the connector 230 is shown in greater detail. The connector 230 includes the first portion 236 as well as the second portion 240. The first portion 236 includes first portion contacts 320 while the second portion 240 includes second portion contacts 322. The contacts 320 and 322 cooperate to provide electrical conductivity from the first portion 236 to the second portion 240 at the connector 230. While the contacts 320 and 322 may have any suitable form, preferably one of the contacts includes a protrusion 324, for example in the form of a pin, while the other contact includes a mating aperture 326 or socket. As shown in FIG. 6A, the first portion contact 320 includes the socket or socket 326, while the second portion contact 322 includes the pin 324. Preferably, the pin 324 is removably connected to the socket 326. The pin 324 and the socket 326 are preferably removably interconnected with a latching mechanism 330. The latching mechanism 330 may be any suitable latching mechanism for example as shown in FIG. 6A the first portion contact 320 may include a pliable clip 332 which interconnects with a assembly 200 at slot 286.

Figure 6B:
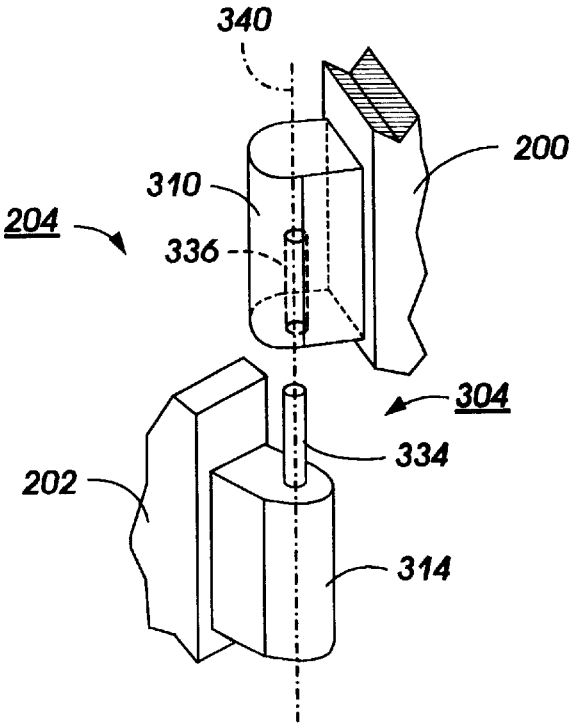
FIG. 6B is a perspective view of the hinge of the modular control assembly of FIG. 1.

Referring now to FIG. 6B, hinge 204 is shown in greater detail. Hinge 204 may be any suitable, durable hinge and be many of any suitable, durable material such as a plastic or a metal, e.g. steel. The hinge 204 is preferably made from two separate portions upper portion 310 and lower portion 314. Preferably, the upper portion 310 is secured to assembly 200 while the lower portion 314 is secured to frame 202 of the interposer 120. The lower portion 314 may include hinge pin 334 which is slidably fit within pintle 336. Pin 334 and pintle 336 rotate about axis 340. Preferably, the lower portion 314 is removably secured to the frame 202. By providing the pin 334 and the pintle 336, the assembly 200 may be removed by simply lifting upwardly along axis 340.

By providing a modular control assembly of the present invention, a copy machine may be provided with few parts and lower costs.

By providing a modular control assembly, electrical components may be located in a central location providing greatly improved accessibility, manufacturability and serviceability to the machine.

By providing a modular control assembly, installation and removal of the electrical components and/or modules may be eased.

By providing a modular control assembly that may be easily detached, the width of the machine may be reduced providing for greater accessibility through narrow halls and doorways.

By providing a modular control assembly with electrical components located on the modular control assembly, the electrical components may be prewired and shipped as an assembly to a manufacturing facility or to a service area for repairs.

By providing electrical components on a modular control assembly, more protection may be afforded to the printed wiring board assemblies and other components. These components may be covered by a simple sheet metal chassis. This chassis provides for a safety envelope around the parts.

By providing a modular control assembly redesign, repositioning and reconfiguration of the mechanical components may be accomplished without the need to position the electrical components among the mechanical components within the Interposer Module.

By providing a modular control assembly, an open chassis design may be provided for the electrical components on the assembly that will provide for natural convection cooling of the electrical components.

By providing a modular control assembly, the electrical components may be preassembled and electrically interconnected at an offsite, away from the manufacturing of the machine itself. The electrical component manufacturing may thus be done in a cleaner, more controlled environment.

By providing a modular control assembly, standardization may be enabled by utilizing standard electrical components and not requiring smaller components to fit within allowable space within the machine.

By providing a modular control assembly, the design of mechanical components and electrical assemblies may be done concurrently and independently providing for reduced time to market for future products.

By providing a modular control assembly and thus separating DC and AC machine components, excellent electromechanical emission management and containment may be accomplished.

By providing a modular control assembly and by separating AC and DC components, noisy AC components may be separated from clean DC components minimizing the cross talk between AC and DC components and the signal harnesses.

It is, therefore, apparent that there has been provided in accordance with the present invention, a modular control assembly that fully satisfies the aims and advantages hereinbefore set forth.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. In a printing machine for producing prints on a substrate, a modular control assembly for controlling a plurality of electromechanical components, said assembly comprising:

a body defining an outer surface thereof and an opposed inner surface thereof;

a plurality of electrical components mounted onto the outer surface of said body, said plurality of electrical components including a plurality of AC electrical components;

a plurality of electrical conduits, each of said conduits electrically connected to at least one of said electrical components; and a plurality of electrical connectors, each of said connectors electrically connected to at least one of said electrical conduits, all of said plurality of electrical connectors interconnected to each other so that said plurality of electrical connectors may be simultaneously connected to said electrical conduits.

2. The control assembly of claim 1, wherein all of said plurality of AC electrical components positioned in a first portion of the outer surface of said body and a plurality of DC electrical components, all of said plurality of DC electrical components positioned in a second portion of the outer surface of said body spaced from the first portion, whereby noise and electromechanical emissions from said plurality of AC electrical components may be separated from said plurality of DC electrical components.

3. The control assembly of claim 1, further comprising a plurality of clamps for securing at least a portion of the plurality of electrical conduits together, said clamps including:

a base;

a first portion extending from said base;

a second portion extending from said base, said first portion and said second portion cooperating with each other to contain the conduits therebetween; and a detent extending from said base for cooperation with said body for securing said base to said body.

4. The control assembly of claim 1, further comprising a hinge for connecting said body to the printing machine, said hinge slidably separable to provide for removal of the modular control assembly from the printing machine.

5. The control assembly of claim 1, further comprising a modular plug for interconnecting a plurality of said electrical connectors.

6. The control assembly of claim 1, further comprising a device for removable mounting said electrical components to said body.

7. The control assembly of claim 1, further comprising a cover attached to said body for protecting the electrical components.

8. A printing machine for producing prints on a substrate comprising:

a frame;

a plurality of electromechanical components mounted to said frame;

a modular control assembly mounted to said frame and extending therefrom, said modular control assembly and said frame defining a first width thereacross, said modular control assembly operably connected to said plurality of electromechanical components for controlling said plurality of electro-mechanical components, the assembly including a body defining an outer surface thereof and an opposed inner surface thereof, a plurality of AC electrical components, a plurality of DC electrical components, a plurality of electrical conduits, each of said conduits electrically connected to at least one of said AC electrical components and said DC electrical components, and a plurality of electrical connectors, each of said connectors electrically connected to at least one of said electrical conduits, said modular control assembly removably mounted to said frame machine so that upon the removal of the modular control assembly from said frame said printing machine defines a second width thereacross, said second width being substantially narrower that said first width so that the printing machine may be more easily transported though a narrow passageway.

9. The printing machine of claim 8:

wherein all of said plurality of AC electrical components positioned in a first portion of the outer surface of said body; and wherein all of said plurality of DC electrical components positioned in a second portion of the outer surface of said body spaced from the first portion, whereby noise and electromechanical emissions from said plurality of AC electrical components may be separated from said plurality of DC electrical components.

10. The printing machine of claim 8, further comprising a hinge mounted on the printing machine, said body pivotably mounted to said hinge.

11. The printing machine of claim 10, wherein said body is slidably removable from said hinge.

12. The printing machine of claim 8, further comprising a plurality of clamps for securing at least a portion of the plurality of electrical conduits together, said clamps including:

a base;

a first portion extending from said base;

a second portion extending from said base, said first portion and said second portion cooperating with each other to contain the conduits therebetween; and a detent extending from said base for cooperation with said body for securing said base to said body.

13. The printing machine of claim 8, further comprising a cover attached to said body for protecting the electrical components.

14. The printing machine of claim 8, further comprising a modular plug for interconnecting a plurality of said electrical connectors.

15. The printing machine of claim 8, further comprising a device for removable mounting said electrical components to said body.

16. A printing machine for producing prints on a substrate, comprising:

a frame;

a plurality of electromechanical components connected to said frame; and a modular control assembly operably associated with said frame and including a body, said assembly electrically connected to said plurality of electromechanical components for controlling said plurality of electromechanical components within the machine, said assembly comprising a plurality of AC electrical components, all of said plurality of AC electrical components positioned in a first portion of an outer surface of said body, a plurality of DC electrical components, all of said plurality of DC electrical components positioned in a second portion of the outer surface of said body spaced from the first portion, said modular control assembly being positioned external to said frame and to said plurality of electromechanical components, said modular control assembly being moveable with respect to said frame so as to provide access to said plurality of electromechanical components.

17. The printing machine of claim 16, further comprising:

a plurality of electrical conduits, each of said conduits electrically connected to at least one of said electrical components; and a plurality of electrical connectors, each of said connectors electrically connected to at least one of said electrical conduits, the electrical connectors mechanically interconnected to each other and to the body so that the electromechanical components may be quickly electrically connectable and disconnectable with the installation and removal of the body.

18. The printing machine of claim 17, further comprising a plurality of clamps for securing at least a portion of the plurality of electrical conduits together, said clamps including:

a base;

a first portion extending from said base;

a second portion extending from said base, said first portion and said second portion cooperating with each other to contain the conduits therebetween; and a detent extending from said base for cooperation with said body for securing said base to said body.

19. The printing machine of claim 16, further comprising a cover attached to said body for protecting said electrical components.

* * * * *